US010526996B2

(12) United States Patent
Yang et al.

(10) Patent No.: US 10,526,996 B2
(45) Date of Patent: Jan. 7, 2020

(54) ADHESION OF THERMAL SPRAY USING COMPRESSION TECHNIQUE

(71) Applicant: GM GLOBAL TECHNOLOGY OPERATIONS LLC, Detroit, MI (US)

(72) Inventors: Jianghuai Yang, Rochester Hills, MI (US); Qigui Wang, Rochester Hills, MI (US); Martin S Kramer, Clarkston, MI (US); Dale A Gerard, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 565 days.

(21) Appl. No.: 15/233,254

(22) Filed: Aug. 10, 2016

(65) Prior Publication Data

US 2018/0045134 A1 Feb. 15, 2018

(51) Int. Cl.

| | |
|---|---|
| ***F02F 1/00*** | (2006.01) |
| ***B24B 5/06*** | (2006.01) |
| ***C23C 4/12*** | (2016.01) |
| ***F02F 1/18*** | (2006.01) |
| ***F02F 7/00*** | (2006.01) |

(52) U.S. Cl.

CPC ..... *F02F 1/004* (2013.01); *B24B 5/06* (2013.01); *C23C 4/12* (2013.01); *F02F 1/18* (2013.01); *F02F 7/0012* (2013.01); *F02F 2200/00* (2013.01)

(58) Field of Classification Search

CPC .. F02F 1/004; F02F 1/18; F02F 7/0012; F02F 2200/00; B24B 5/06; C23C 4/02; C23C 4/12

See application file for complete search history.

(56) References Cited

U.S. PATENT DOCUMENTS

| | | | | |
|---|---|---|---|---|
| 5,080,056 A * | 1/1992 | Kramer | ..... | F02F 7/0007 123/193.4 |
| 5,622,753 A * | 4/1997 | Shepley | ..... | C23C 4/02 427/233 |
| 7,341,533 B2 | 3/2008 | Wang | | |
| 7,632,519 B2 | 12/2009 | Jamieson | | |

(Continued)

FOREIGN PATENT DOCUMENTS

CN 1954090 A 4/2007

OTHER PUBLICATIONS

3D S Parameters—Hybrid Parameters; 3D S Hybrid Parameters: Sdr-Michigan Metrology; www.michmet.com; p. 1.

(Continued)

*Primary Examiner* — Ryan J. Walters

(57) ABSTRACT

An improved surface activation technique improves the adhesion of thermal spray coatings, which is useful for engine cylinder bores. The new method includes compressing the cylinder bore surface to create a surface profile on the surface, such as through rolling a roller along the surface. An engine block is also provided, which includes a plurality of cylinder bores, each cylinder bore having an inner surface, and each inner surface having a surface profile that includes a helical groove and other surface profiles formed in the inner surface. A thermal spray coating is formed on the inner surface of each cylinder bore, the thermal spray coating being adhered to the surface profile of the inner surface. A roller assembly for activating the surface is also provided.

7 Claims, 6 Drawing Sheets

(56) References Cited

U.S. PATENT DOCUMENTS

| | | | | |
|---|---|---|---|---|
| 7,700,212 | B2 | 4/2010 | Elhamid | |
| 8,859,041 | B2 | 10/2014 | Sekikawa et al. | |
| 2006/0159848 | A1 | 7/2006 | Wang | |
| 2013/0047947 | A1* | 2/2013 | Whitbeck | B23B 27/24 123/193.2 |
| 2016/0018315 | A1 | 1/2016 | Wang | |
| 2016/0130691 | A1 | 5/2016 | Wang | |
| 2016/0258047 | A1 | 8/2016 | Wang | |

OTHER PUBLICATIONS

Screw Thread Design; Federal Engineering & Design Support(F.E.D.S.) www.engineer@fastenal.com; pp. 1-7.

US Application Filing date Jun. 8, 2015 U.S. Appl. No. 14/733,121 Applicant: GM Global Technology Operations LLC; Title: TiO2 Application as Bondcoat for Cylinder Bore Thermal Spray.

US Application Filing dated Jun. 29, 2015 U.S. Appl. No. 14/753,152 Applicant: GM Global Technology Operations LLC; Title: Phosphating or Anodizing for Improved Bonding of Thermal Spray Coating on Engine Cylinder Bores.

US Application Filing date Jun. 16, 2016 U.S. Appl. No. 15/184,699 Applicant: GM Global Technology Operations LLC; Title: Surface Texture Providing Improved Thermal Spray Adhesion.

* cited by examiner

ADHESION OF THERMAL SPRAY USING COMPRESSION TECHNIQUE

FIELD

The present disclosure relates to improving the adhesion of thermal spray coatings to surfaces and more particularly to surface activation that provides improved adhesion of thermal spray coatings to such surfaces.

INTRODUCTION

Thermal spraying is a coating process which applies material heated and typically melted by combustion or an electrical plasma or arc to a substrate. The process is capable of rapidly applying a relatively thick coating over a large area relative to other coating processes such as electroplating, sputtering and physical and vapor deposition.

The ruggedness and durability of the thermal spray coating would seem to be almost exclusively a feature of the material of the coating and to a lesser extent the quality of application. However, it has been determined that, in fact, typically the most significant factor affecting the ruggedness and durability of a thermal spray coating is the strength of the bond between the thermal spray coating and the surface. A poor bond may allow the thermal spray coating to crack or peel off, sometimes in relatively large pieces, long before the thermal sprayed material has actually worn away, whereas a strong bond renders the thermal spray coating an integral and inseparable component of the underlying surface.

Several approaches have been undertaken to improve the bond between the thermal spray coating and the underlying surface. Some processes involve removing part of the surface material to increase roughness prior to application of the thermal spray. However, these processes can be time consuming (sometimes requiring multiple steps) and can require expensive tools. Furthermore, existing processes may fail to sufficiently improve adhesion.

SUMMARY

The present disclosure provides an improved substrate surface texture, which improves the adhesion of thermal spray coatings. Thus, a method, tool, and engine block are disclosed that provide for improved adhesion of a thermal spray coating.

In one form, which may be combined with or separate from the other forms disclosed herein, a method of activating an inner surface of an engine cylinder bore to achieve better adhesion between a subsequently-applied coating and the inner surface is provided. The method includes compressing the inner surface to create a surface profile on the inner surface.

In another form, which may be combined with or separated from the other forms described herein, an engine block is provided that includes a plurality of cylinder bores. Each cylinder bore has an inner surface, and each inner surface has a surface profile that includes a helical groove formed in the inner surface. A thermal spray coating is formed on the inner surface of each cylinder bore. The thermal spray coating is adhered to the surface profile of the inner surface.

In yet another form, which may be combined with or separated from the other forms described herein, a roller assembly for activating an inner surface of an engine cylinder bore is provided. The roller assembly includes a central shaft defining a central axis and a roller configured to rotate about the central axis. The roller has an activating edge configured to compress a groove into an inner surface of an engine cylinder bore.

Additional features may be provided, such as: the step of compressing the inner surface including rolling a roller along the inner surface; the step of compressing the inner surface including creating a texture on the inner surface; the step of compressing the inner surface further including rolling a second roller along the inner surface; the step of compressing the inner surface further including rolling a third roller along the inner surface; the rolling of the first, second, and third rollers along the inner surface being performed simultaneously to maintain bore concentricity; depositing a thermal spray coating on the inner surface; the first roller is provided as having a first roller pattern configuration and the second roller is provided as having a second roller pattern configuration; the first roller pattern configuration being different than the second roller pattern configuration; the step of compressing the inner surface including creating a helical groove in the inner surface; the step of compressing the inner surface including creating a plurality of dimples in the inner surface; the helical groove being a first helical groove, and creating a second helical groove through a first flank of the first helical groove; creating a third helical groove through a second flank of the first helical groove; the surface profile of each inner surface including a plurality of dimples formed in the inner surface; creating compressive residual stress in the cylinder bore; the compressive residual stress having a magnitude of at least 250 MPa; the helical groove having a helical angle of about 5 to about 20 degrees; the texture including a plurality of rough textures each having radii greater than 10 μm; the textures having a developed interfacial area ratio (Sdr) greater than 100% to enhance coating adhesion; providing each of the helical grooves as having a pitch in the range of about 150 to about 250 μm; providing the first helical groove as having a depth of about 100 to about 250 μm; providing each of the dimples as having a diameter of about 20 to about 30 μm; and the first and the second flanks defining an angle of about 60 to about 75 degrees therebetween.

Further additional features may include the following: each of the inner surfaces of the cylinder bores being formed of aluminum; the roller being a first roller; the roller assembly further comprising a second roller configured to rotate about the central axis and to activate the inner surface of the engine cylinder bore; at least one of the first and second rollers comprising a plurality of micro projections extending from an outer edge; the plurality of micro projections being configured to create a plurality of dimples in the inner surface of the engine cylinder bore; the roller assembly further comprising a third roller configured to rotate about the central axis and to activate the inner surface of the engine cylinder bore; the first, second, and third rollers being spaced about equidistant from each other and from the central axis; a first axle about which the first roller is configured to rotate; a second axle about which the second roller is configured to rotate; a third axle about which the third roller is configured to rotate; a first roller shaft coupled to the first axle; the first roller shaft extending from the central shaft; a second roller shaft coupled to the second axle; the second roller shaft extending from the central shaft; a third roller shaft coupled to the third axle; the third roller shaft extending from the central shaft; the first roller shaft being disposed along a first plane; the second roller shaft being disposed along a second plane; the third roller shaft being disposed along a third plane; the first, second, and third planes being parallel to each other; the first plane being disposed about 50 to about 80 μm from the second plane; the first plane being disposed about 50 to about 80 μm from the third plane; and a second axle about which the second and third rollers are configured to rotate.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
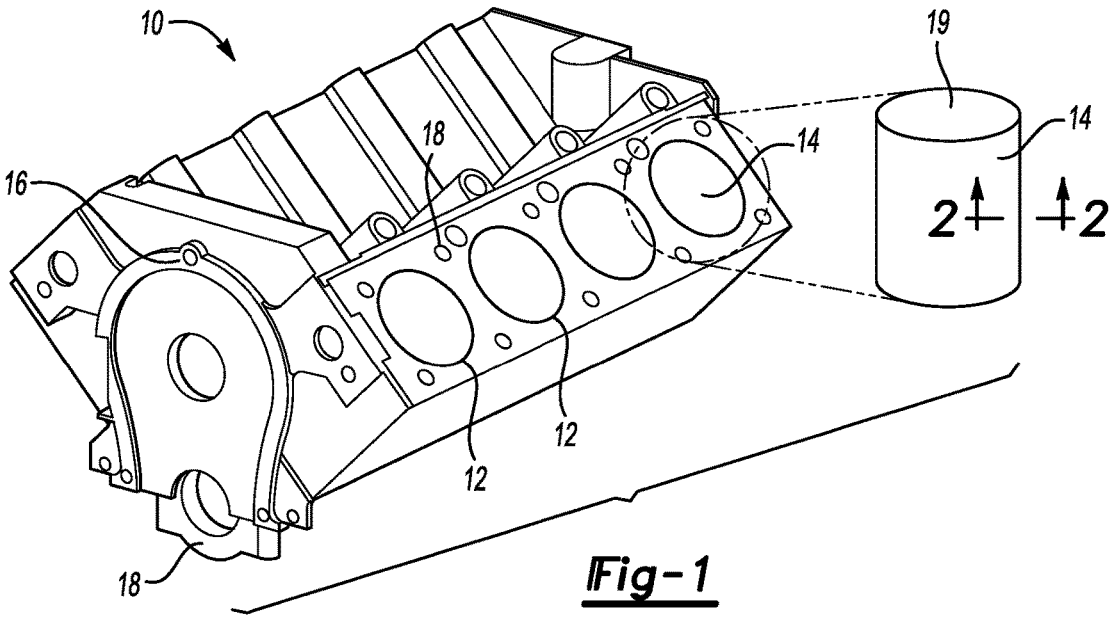
FIG. 1 is a schematic perspective view of an internal combustion engine block with an enlarged view of a cylinder bore wall, in accordance with the principles of the present disclosure.

With reference to FIG. 1, an internal combustion engine block is illustrated and generally designated by the reference number 10. The engine block 10 typically includes a plurality of cylinders 12 having interior cylinder bores 14, numerous flanges 16 and openings 18 for threaded fasteners and other features for receiving and securing components such as cylinder heads, shafts, manifolds and covers (all not illustrated).

On the right side of FIG. 1 is an enlarged representation of the cylinder bore 14. The cylinder bore 14 may be a surface of a substrate such as an aluminum engine block 10 or a surface of an iron sleeve that has been installed in the engine block 10. Thus, the cylinder bore 14 has an inner surface wall 19. In either case, the surface finish of the inner surface 19 of the cylinder bore 14 may be a machined profile which is mechanically roughened or activated.

It will be appreciated that although illustrated in connection with the cylinder bore 14 of an internal combustion engine 10, with which it is especially beneficial, the present disclosure provides benefits and is equally and readily utilized with other cylindrical surfaces such as the walls of hydraulic cylinders and flat surfaces such as planar bearings which are exposed to sliding, frictional forces.

Figure 2:
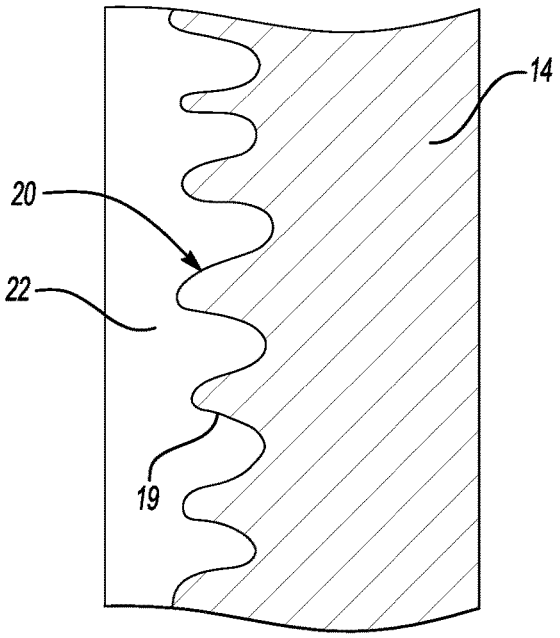
FIG. 2 is an enlarged schematic cross-sectional view of a portion of the cylinder bore wall having a thermal spray coating applied thereto, taken along line 2-2 of FIG. 1, schematically showing a surface texture of the cylinder bore wall, according to the principles of the present disclosure.

Referring now to FIG. 2, an enlarged cross-section of a portion of the cylinder bore 14 schematically illustrates the surface texture 20 of the activated surface of the inner surface 19 of the cylinder bore 14. The surface texture 20 is created by compression of the inner surface 19. In one example, the surface texture 20 is created by rolling a roller against the inner surface 19 of the cylinder bore 14 to compress the inner surface 19 and create a groove in the inner surface 19, which will be described in greater detail below.

A thermal spray coating 22 is applied and adhered to the surface profile 20 of the inner surface 19. Typically, the thermal spray coating 22 for the inner surface 19 described herein, after honing, may be on the order of about 150 μm and is typically within the range of from about 130 μm to about 175 μm. Some applications may require thermal spray coatings 22 having greater or lesser thicknesses, however. The thermal spray coating 22 may be a steel or a steel alloy, another metal or alloy, a ceramic, or any other thermal spray material suited for the service conditions of the product and may be applied by any one of the numerous thermal spray processes such as plasma, detonation, wire arc, flame, or HVOF suited to the substrate and material applied.

Figure 3B:
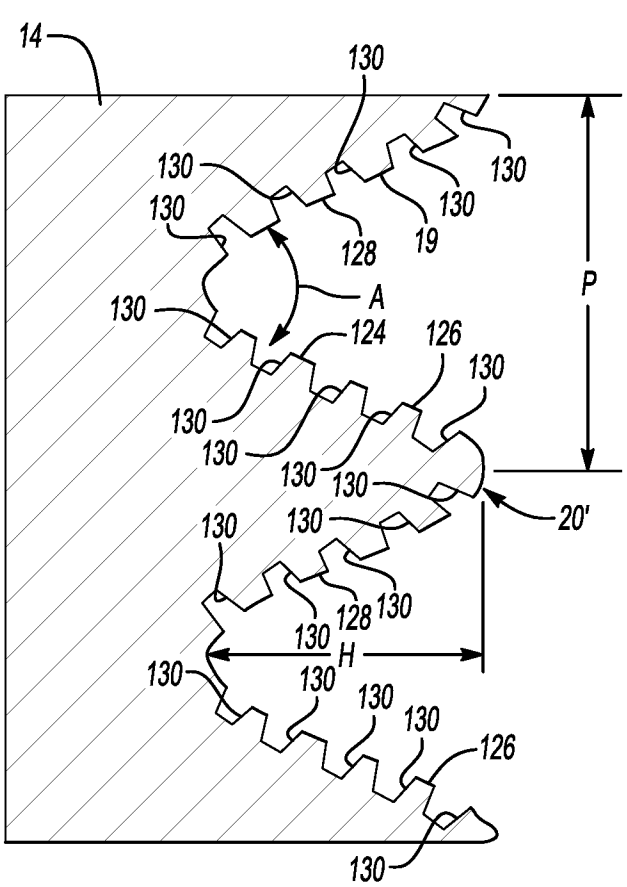
FIG. 3B is a greatly enlarged schematic cross-sectional view of a portion of a second example of the cylinder bore wall of FIG. 2, with the thermal spray coating removed for clarity, showing a second configuration of the surface profile texture of the cylinder bore wall, according to the principles of the present disclosure.
Figure 3A:
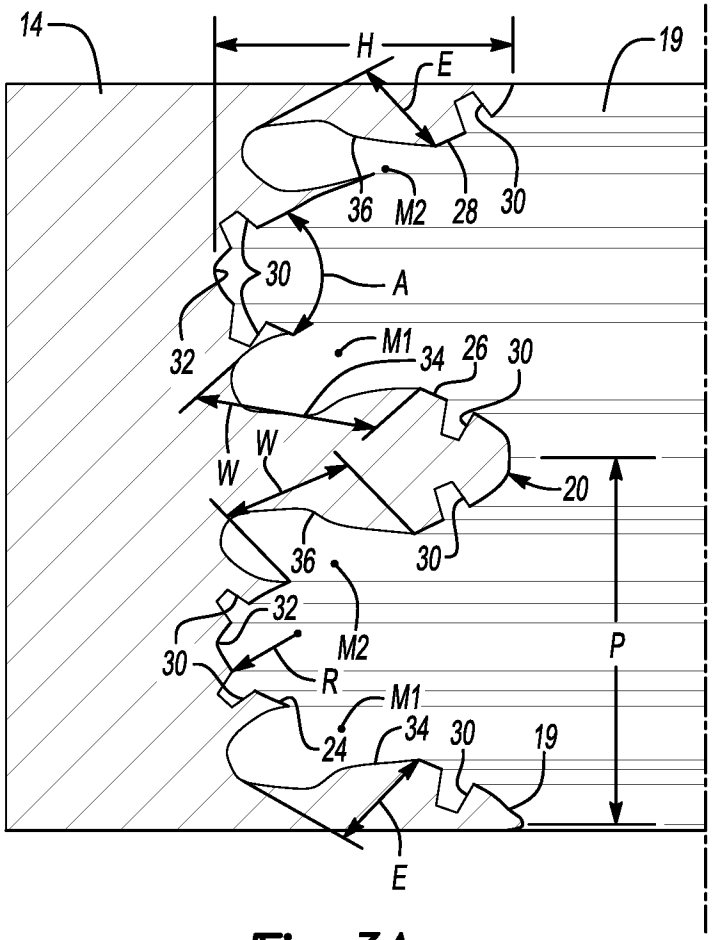
FIG. 3A is a greatly enlarged schematic cross-sectional view of a portion of a first example of the cylinder bore wall of FIG. 2, with the thermal spray coating removed for clarity, showing a first configuration of the surface profile texture of the cylinder bore wall, in accordance with the principles of the present disclosure.

Referring now to FIG. 3A, one example of the surface profile 20 of the inner surface 19 of the cylinder bore 14 is illustrated. The inner surface 19 of the cylinder bore 14 has a surface profile 20 that forms at least one helical groove 24 on the inner surface 19. For example, a large main groove 24 may be rolled or compressed into the inner surface wall 19 by a first roller (explained in more detail below), resulting in a helical main groove 24 having a pitch P in the range of about 150 to about 250 μm and a thread height H, or depth, of about 100 to about 250 μm. The main groove 24 may have a first flank 26 opposite a second flank 28, with an angle A of about 60 to about 75 degrees defined between walls of the first and second flanks 26, 28. The helical groove 24 may have a helical angle in the range of about 5 to about 20 degrees, by way of example.

Furthermore, the surface profile 20 in the inner surface 19 of the cylinder bore 14 may include portions forming a plurality of cavities or dimples 30 in the inner surface 19. The plurality of dimples 30 may be formed along the first and second flanks 26, 28 (and/or in the valley 32 of the groove 24, in some examples, not shown), within the inner surface 19. Each dimple 30 may have a diameter in the range of about 20 to about 30 μm, by way of example.

A secondary helical groove 34 may be formed through the first flank 26 of the main groove 24. For example, the secondary groove 34 may be formed through a midpoint M1 of the thread height H of the first flank 26. Similarly, if desired, a third helical groove 36 may be formed through the second flank 28 of the main groove 24. The third groove 36 may be formed through a midpoint M2 of the thread height H of the second flank 28. The secondary and third grooves 34, 36 may have widths W of about 50 to about 80 μm and depths E of about 50 to about 100 μm, by way of example. The secondary and third grooves 26, 28 may also include their own dimples, if desired (not shown).

After having been compressed, for example by rolling, to create one or more of the grooves 24, 34, 36 and/or dimples 30, each cylinder bore 14 comprises compressive residual stress. The resultant compressive residual stress may have a magnitude of at least 250 MPa; in other words, the compressive residual stress may be less than or equal to −250 MPa.

Each valley 32 can be formed to have a root radius R in the range of about 30 to about 50 μm. The root radius may be determined by the equation:

$$R = \frac{2\gamma}{P} \tag{1}$$

where γ is the surface tension of the steel or steel alloy coating 22, and P is the pressure applied to the liquid steel or steel alloy during the thermal spray application. The root radius R determines the splat size of atomized steel droplets.

The resulting rough textures 24, 30, 34, 36 that make up the surface profile 20 may have radii greater than 10 μm and developed interfacial area ratio (Sdr) greater than 100% to enhance coating adhesion. Sdr is computed from the standard equation:

$$Sdr = \frac{\text{Surface Area of the Textured Surface} - \text{Cross Sectional Area}}{\text{Cross Sectional Area}} \tag{2}$$

For example, a unit of cross sectional area which has two units of area of textured surface has an Sdr percent of 100 ((2−1)/1). Generally speaking, the greater the Sdr, the greater the adhesion strength. Experimentation and life testing has determined that the adhesion achieved for Sdr's below 100% generally provides compromised ruggedness, durability and thus service life. Accordingly, in at least some embodiments of the present disclosure, the Sdr is at or above 100%.

Referring now to FIG. 3B, another example of the surface profile of the inner surface 19 of the cylinder bore 14 is illustrated, which is generally designated as 20'. It should be understood that the cylinder bore 14 having the surface profile 20' of FIG. 3B may have the same characteristics as hereinbefore described, except where specifically described as being different from the surface profile 20 shown in FIG. 3A. The surface profile 20' forms at least one helical groove 124 on the inner surface 19. For example, a large main groove 124 may be rolled or compressed into the inner surface wall 19 by a first roller (explained in more detail below), resulting in a helical main groove 124 having a pitch P in the range of about 150 to about 250 μm and a thread height H, or depth, of about 100 to about 250 μm. The main groove 124 may have a first flank 126 opposite a second flank 128, with an angle A of about 60 to about 75 degrees defined between walls of the first and second flanks 126, 128.

Furthermore, the surface profile 20' activated in the inner surface 19 of the cylinder bore 14 may include portions forming a plurality of cavities or dimples 130 in the inner surface 19. The plurality of dimples 130 are formed along the first and second flanks 126, 128 (and/or in the valley 132 of the groove 124, in some examples, not shown), within the inner surface 19. Each dimple 130 may have a diameter in the range of about 20 to about 30 μm, by way of example. The surface profile 20' lacks the secondary and third grooves 34, 36 illustrated in FIG. 3A.

The surface profile 20' may be the entirety of the surface profile activated in a particular engine block 10. For example, the surface profile 20' may be created by a single roller wheel. In the alternative, the surface profile 20' may represent an intermediate surface profile that has been rolled by a first roller (described in greater detail below), prior to rolling second and/or third rollers to create the secondary and third grooves 34, 36 shown in FIG. 3A.

Figure 3C:
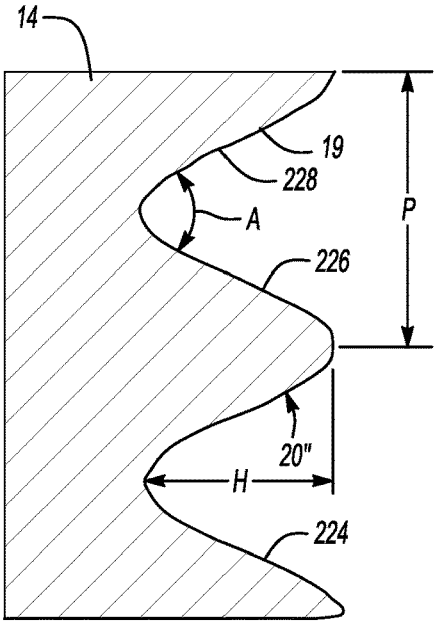
FIG. 3C is a greatly enlarged schematic cross-sectional view of a portion of a third example of the cylinder bore wall of FIG. 2, with the thermal spray coating removed for clarity, showing a third configuration of the surface profile texture of the cylinder bore wall, in accordance with the principles of the present disclosure.

Referring now to FIG. 3C, yet another example of the surface profile of the inner surface 19 of the cylinder bore 14 is illustrated, which is generally designated as 20". It should be understood that the cylinder bore 14 having the surface profile 20" of FIG. 3C may have the same characteristics as hereinbefore described, except where specifically described as being different from the surface profiles 20, 20' shown in FIG. 3A or FIG. 3B. The surface profile 20" forms at least one helical groove 224 on the inner surface 19. For example, a large main groove 224 may be rolled or compressed into the inner surface wall 19 by a first roller (explained in more detail below), resulting in a helical main groove 224 having a pitch P in the range of about 150 to about 250 μm and a thread height H, or depth, of about 100 to about 250 μm. The main groove 224 may have a first flank 226 opposite a second flank 228, with an angle A of about 60 to about 75 degrees defined between walls of the first and second flanks 226, 228.

The surface profile 20" lacks the dimples 30, 130 illustrated in FIGS. 3A-3B. Such a surface profile 20" may provide adequate surface roughness for lower coating adhesion force applications, such as lower power density engines. In the illustrated example, the surface profile 20" also lacks the secondary and third grooves 34, 36 illustrated in FIG. 3A; however, if desired, secondary and third grooves (such as elements 34 and 36 shown in FIG. 3A) can be included in the flanks 226, 228 of the main groove 224, similar to the secondary and third grooves shown in FIG. 3A.

The surface profile 20" may be the entirety of the surface profile activated in a particular engine block 10. In the alternative, the surface profile 20" may represent an intermediate surface profile that has been rolled by a first roller (described in greater detail below), prior to rolling second and/or third rollers to create the secondary and third grooves 34, 36 shown in FIG. 3A.

Figure 4:
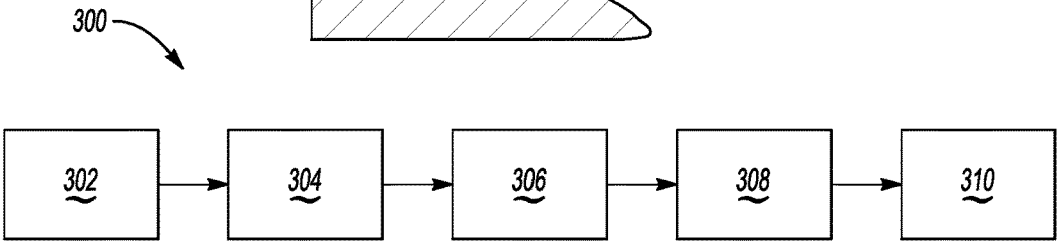
FIG. 4 is a block diagram illustrating a method of creating an engine cylinder bore, including a method of activating an inner surface of an engine cylinder bore to achieve better adhesion between a subsequently-applied coating and the inner surface, according to the principles of the present disclosure.

Referring now to FIG. 4, a method 300 of activating an inner surface 19 of an engine cylinder bore 14 to achieve better adhesion between a subsequently-applied coating and the inner surface 19 will now be described. The method 300 includes compressing the inner surface 19 to create a surface profile on the inner surface. In other words, instead of (or in addition to) removing material from the inner surface 19 using a tool to remove material, or by erosion through water jetting, for example, the aluminum material of the cylinder bore 14 is compressed. In some examples, the method 300 includes compressing the inner surface 19 by rolling at least one roller along the inner surface.

The method 300 may include a step 302 of pre-machining the cylinder bores within an engine block. The method 300 may then include a step 304 compressing the inner surfaces of the cylinder bores to activate the surfaces for better adhesion of a subsequently-applied thermal spray. For example, one or more micro rollers may be rolled along the inner surfaces to create grooves, such as one or more of the helical grooves 24, 34, 36, 124, 224 described above. Creating the grooves results in a surface texture on the inner surface of the cylinder bores. The step 304 may include rolling a first roller, a second roller, and/or a third roller along the inner surface of each cylinder bore, to create a surface profile, such as one of the surface profiles 20, 20', 20" described above. Each of the rollers, if more than one are used, can be rolled simultaneously along the inner surface 19 of the cylinder bore 14 to maintain concentricity of the cylinder bore.

In step 306, the method 300 may optionally include washing of the cylinder bores 14, for example, after compressing the inner surface 19 with the roller or rollers. The method 308 then includes a step 308 of thermal spraying, or depositing a thermal spray coating, on the inner surface 19. The method 300 may then proceed to step 310 of inspecting the thermally sprayed inner surfaces, if desired.

In order to perform the method 300, certain optional steps may be included. For example, the first roller may be provided as having a first roller pattern configuration and a second roller may be provided as having a second roller pattern configuration, where the first roller pattern configuration is different than the second roller pattern configuration. Both rollers can be rolled along the inner surface to create different features in the surface profile. In the alternative, both the first and second rollers can be provided having identical roller pattern configurations. Similarly, a third, fourth, or fifth (or additional) roller may be provided having the same or different roller pattern configurations to create additional surface texture. Each of the rollers can be rolled along the inner surface 19 to compress material of the inner surface 19, either simultaneously or sequentially.

The compressing step 304 may also include rolling a helical groove into the inner surface 19, as shown in FIGS. 3A-3C, by way of example. If multiple rollers are used, each may be used to create its own helical groove, as shown in FIG. 3A, by way of example. Thus, the method 300 may include creating first, second, and third helical grooves within the inner surface 19. The compressing step 304 may also include creating a plurality of dimples in the inner surface 19, as shown in FIGS. 3A-3B, by way of example. The compressing step 304 may also include creating compressive residual stress in the cylinder bore, having a magnitude of at least 250 MPa (or less than −250 MPa compressive residual stress). The compressing step 304 of the method 300 may include creating a plurality of rough textures, each having radii greater than 10 μm and developed interfacial area ratio (Sdr) greater than 100% to enhance coating adhesion. Further, the compressing step 304 of the method 300 may include creating one or more helical grooves having a pitch of about 150 to about 250 μm, a depth (or thread height) of about 100 to about 250 μm, and the compressing step 304 of the method 300 may include creating dimples having a diameter of about 20 to about 30 μm. Additional details of the method 300 may be incorporated in the description of a roller assembly, which can be used to perform the method 300, as described below.

Figure 5:
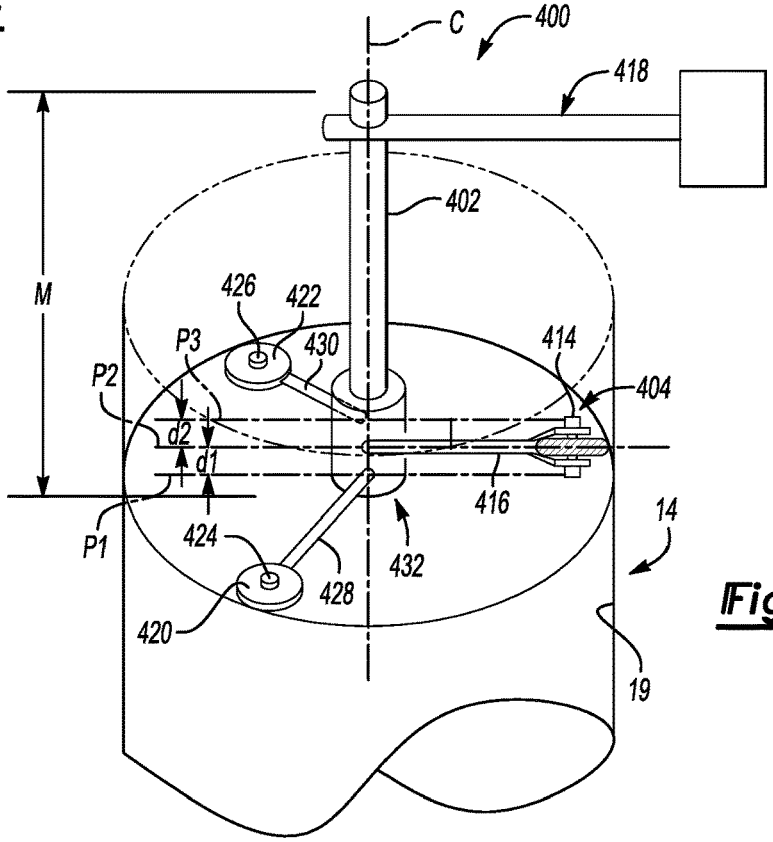
FIG. 5 is a schematic perspective view of a roller assembly shown in a schematic see-through cylinder bore, in accordance with the principles of the present disclosure.

Referring now to FIG. 5, a roller assembly for activating an inner surface of an engine cylinder bore is illustrated schematically and generally designated at 400. The cylinder bore 14 and inner surface 19 are sketched in for clarity only, as being see-though, though it should be understood that one would not be able to see through the cylinder bore 14 or inner surface 19 in actual application.

The roller assembly 400 may include a central shaft 402 defining a central axis C therethrough. In the illustrated embodiment, the central axis C also runs coaxially with a central axis of the cylinder bore 14, and thus, the central axis C is the central axis of the cylinder bore 14. At least one roller 404 is provided and configured to rotate about the central axis C.

Figure 6A:
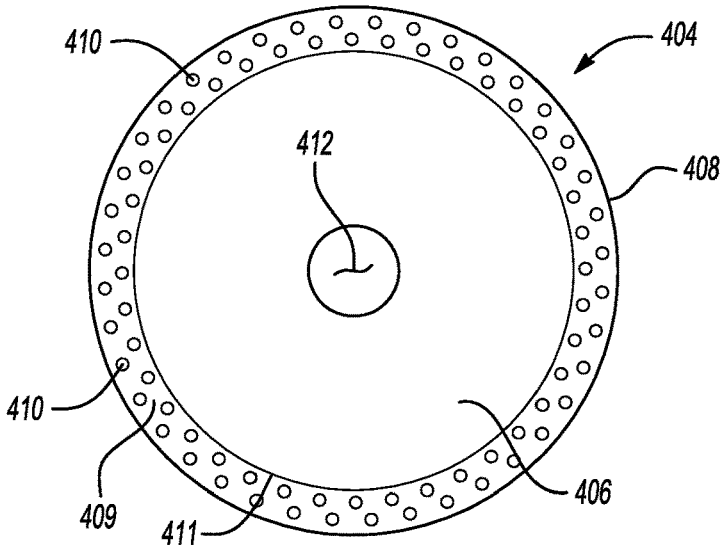
FIG. 6A is a schematic plan view of a first wheel of the roller assembly of FIG. 5, according to the principles of the present disclosure.
Figure 6B:
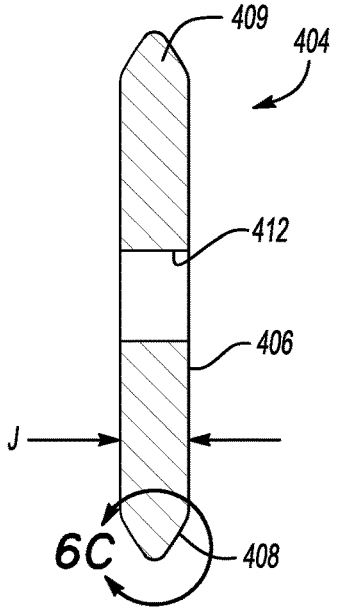
FIG. 6B is a schematic cross-sectional view of the first wheel shown in FIGS. 5-6A, in accordance with the principles of the present disclosure.
Figure 6C:
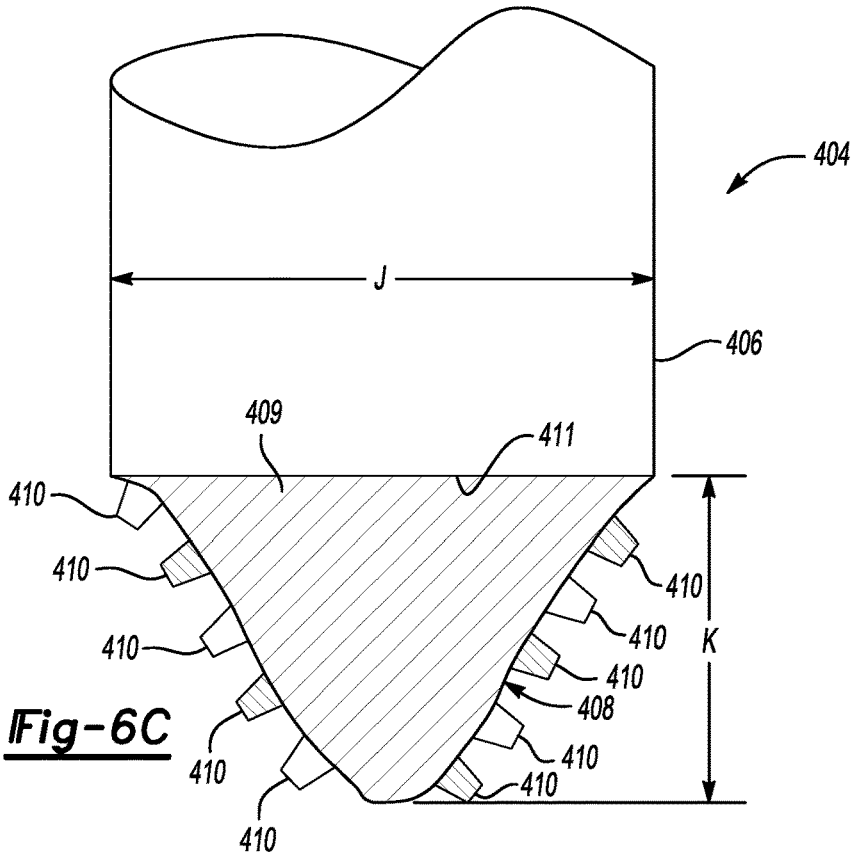
FIG. 6C is a close-up schematic cross-sectional view of the first wheel shown in FIGS. 5-6B, taken along the cut-out circle 6C of FIG. 6B, according to the principles of the present disclosure.

Referring to FIGS. 6A-6C, additional details of the roller 404 are shown. The roller 404 is a main roller or first roller, in this example. The roller 404 is a wheel that has a main body portion 406 and an activating edge 408 configured to compress a groove into the inner surface 19 of the engine cylinder bore 14, as shown in FIGS. 3A-3C. The activating edge 408 is configured to compress a helical groove into the inner surface 19 of the cylinder bore 14 as the roller 404 is rolled along the inner surface 19, as shown in FIGS. 3A-3C above. The activating edge 408 may be disposed on an activating portion 409 that extends from an outer portion 411 of the main body portion 406 of the roller 404.

The roller 404 may also include a plurality of micro projections 410 extending from the outer edge (activating edge 408). The micro projections 410 are configured to create a plurality of dimples in the inner surface 19 of the engine cylinder bore 14, such as shown and described above in FIGS. 3A-3B, through compression of the micro projections 410 against the inner surface 19 as the roller 404 is rolled along the inner surface 19.

The main body 406 of the roller 404 may have a height J of about 200 to about 250 μm, or any other desired height to create the helical groove, such as helical groove 24, in the inner surface 19. Similarly, the activating portion 409 may have a width K in the range of about 200 to about 250 μm. Further, the micro projections 410 may be provided as spines, bumps, or any other desired shape, to create dimples, such as the dimples 30, 130 shown in FIGS. 3A-3B.

The roller 404 has a central aperture 412 formed through the height J of the main body portion 406. A pin or axle 414 may extend through the aperture 412 so that the roller 404 may rotate about the axle 414. A roller shaft 416 is coupled to the axle 414. The roller shaft 416 is also coupled to the central shaft 402. A crank 418 may be coupled to the central shaft 402 so that the central shaft 402 is rotatable about the central axis C. Turning the crank 418 may cause the roller 404 to be rotated about axle 414 and about the central axis C to form a groove (such as groove 24) in the inner surface 19.

In some examples, the roller assembly 400 also includes a second roller 420 and a third roller 422. The roller assembly 400 could have any desired number of rollers 404, 420, 422, such as one, two, three, four, five, or six rollers 404, 420, 422. The rollers 404, 420, 422 may be spaced equidistant from each other and from the central axis C, to maintain concentricity of the cylinder bore 14 as the rollers 404, 420, 422 are being rolled along the inner surface 19 of the cylinder bore 14. Thus, like the first roller 404, the second and third rollers 420, 422 are each configured to rotate about an axle 424, 426 that is coupled to a roller shaft 428, 430 extending from the central axis 402, and each roller 420, 422 is configured to rotate about the central axis C to activate the inner surface 19. Therefore, the first, second, and third rollers 404, 420, 422 may be rolled along the inner surface 19 simultaneously to maintain bore concentricity by rotating the shaft 402.

Along the height M of the central shaft 402, each of the roller shafts 416, 428, 430 may be positioned about 50 μm from another of the roller shafts 416, 428, 430. For example, the second roller shaft 428 may be positioned at or near a distal end 432 of the central shaft 402, and the first roller shaft 416 may be positioned a distance d1 from the second roller shaft 428, where d1 is about 50 μm. Similarly, the third roller shaft 430 may be positioned a distance d2 from the first roller shaft 416, where d2 is also equal to about 50 μm.

In other words, the roller shaft 416 may be disposed along a first plane P1, the second roller shaft 428 may be disposed along a second plane P2, and the third roller shaft 430 may be disposed along a third plane P2, where the first, second, and third planes P1, P2, P3 are parallel to each other. The first plane P1 may be disposed about 50 to about 80 μm from the second plane P2, and the first plane P1 may also be disposed about 50 to about 80 μm from the third plane P3. Thus, in this example, the first plane P1 is located between the second and third planes P2, P3.

The micro projections 410 extending from the activating surface 408 of the first roller 404 are illustrated having a cross section of a trapezoid in FIG. 6C. Accordingly, in a three-dimensional view, the micro projections 410 could be understood to have a trapezoidal prism shape. Each micro projection 410 could have a diameter of about 20 to about 50 μm, by way of example.

Referring now to FIGS. 7A-7F, other examples of variations of the micro projections 410*a*-410*f* are illustrated. Any of shapes of the micro projections 410*a*-410*f* illustrated could be substituted for the micro projection 410 illustrated in FIG. 6C, or any other shape not illustrated could be used. In addition, the multiple different shapes for the micro projection 410, 410*a*-410*f* could be used on a single activating edge 408 of the roller 404. For example, the micro projections 410, 410*a*-410*f* could alternate in shape along the activating edge 408.

Figure 7A:
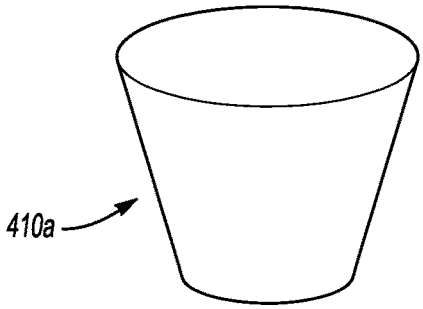
FIG. 7A is a schematic perspective view of an example of a bump or protrusion extending from the first wheel shown in FIGS. 5-6C, in accordance with the principles of the present disclosure.
Figure 7B:
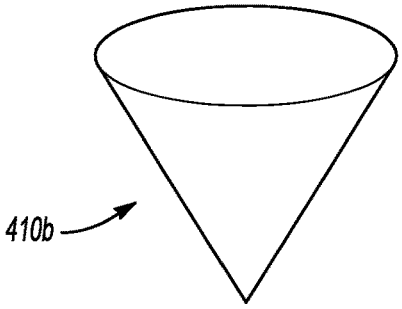
FIG. 7B is a schematic perspective view of another example of a bump or protrusion extending from the first wheel shown in FIGS. 5-6C, according to the principles of the present disclosure.
Figure 7C:
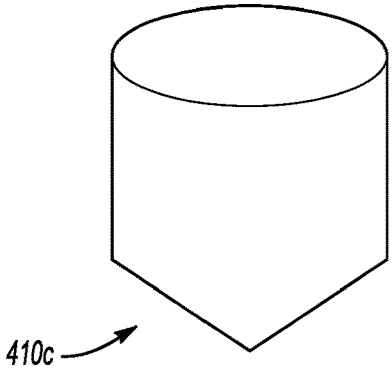
FIG. 7C is a schematic perspective view of yet another example of a bump or protrusion extending from the first wheel shown in FIGS. 5-6C, in accordance with the principles of the present disclosure.
Figure 7D:
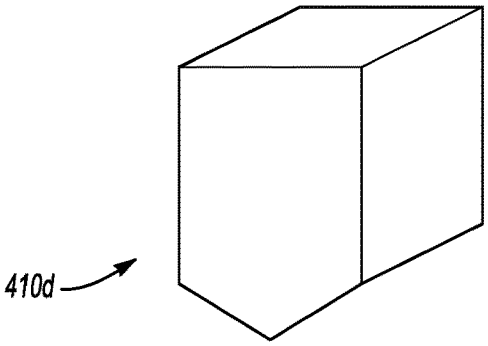
FIG. 7D is a schematic perspective view of still another example of a bump or protrusion extending from the first wheel shown in FIGS. 5-6C, according to the principles of the present disclosure.
Figure 7E:
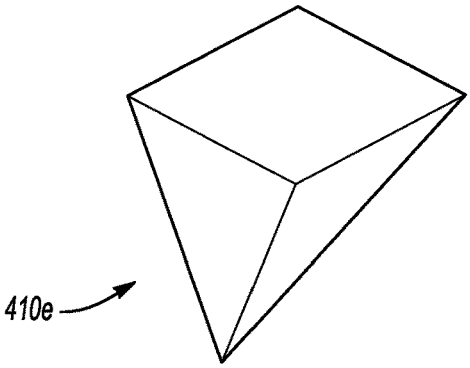
FIG. 7E is a schematic perspective view of still another example of a bump or protrusion extending from the first wheel shown in FIGS. 5-6C, in accordance with the principles of the present disclosure.
Figure 7F:
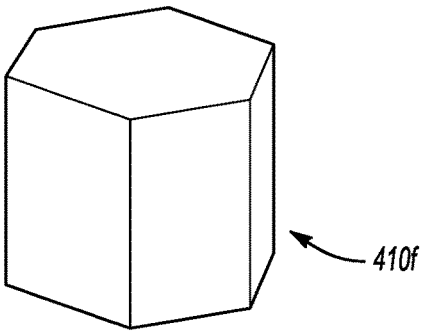
FIG. 7F is a schematic perspective view of still another example of a bump or protrusion extending from the first wheel shown in FIGS. 5-6C, according to the principles of the present disclosure.

Referring to FIG. 7A, for example, any micro projection 410 on the activating edge 408 could have a rounded edge and/or the shape of a flattened mountain top, the micro projection labeled as element 410*a* in this variation. Referring to FIG. 7B, any micro projection 410 on the activating edge 408 could have a cone shape, the micro projection labeled as element 410*b* in this variation. Referring to FIG. 7C, any micro projection 410 on the activating edge 408 could have a combined shape, such as a cone atop a cylinder, the micro projection labeled as element 410*c* in this variation. Referring to FIG. 7D, any micro projection 410 on the activating edge 408 could have another combined shape, such as a triangular prism atop a cube or rectangular solid, the micro projection labeled as element 410*d* in this variation. Referring to FIG. 7E, any micro projection 410 on the activating edge 408 could have a tetrahedron shape, the micro projection labeled as element 410*e* in this variation. Referring to FIG. 7F, any micro projection 410 on the activating edge 408 could have a hexagonal shape, such as a hexagonal prism or hexagonal solid shape, the micro projection labeled as element 410*f* in this variation. Though example micro projection shapes 410, 410*a*-*f* are illustrated in FIGS. 6C and 7A-7F, it should be understood that the micro projections 410 could have any other suitable shape to activate the inner surface 19, without falling beyond the spirit and scope of the present disclosure.

Figure 8:
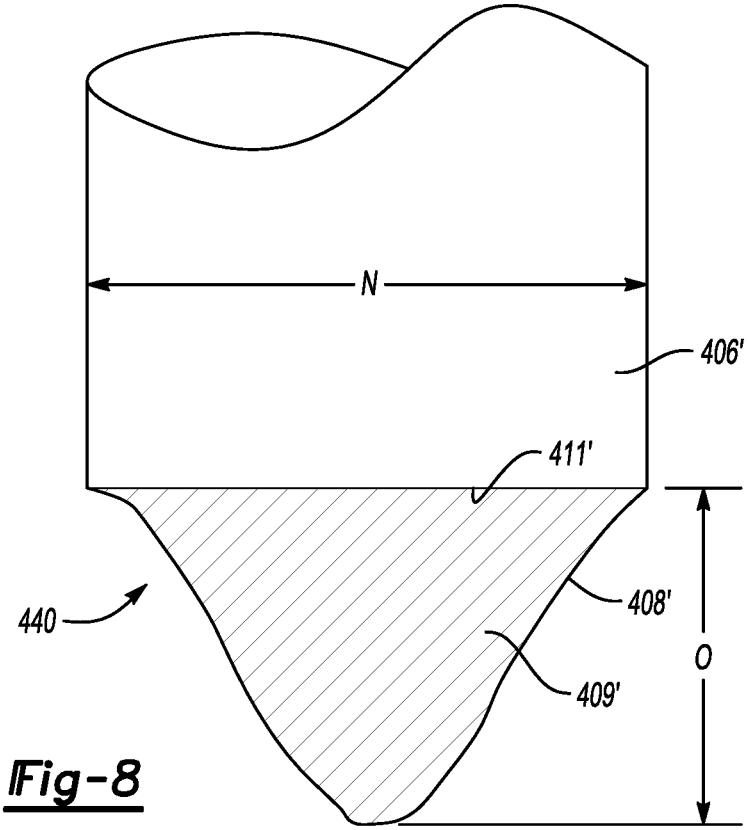
FIG. 8 is a close-up schematic cross-sectional view of an example of a portion of a wheel shown in FIG. 5, in accordance with the principles of the present disclosure.

Referring now to FIG. 8, one variation of a roller is illustrated and designated at numeral 440. This numbering convention indicates that the roller configuration 404', 420', 422' could be used to substitute for any or all of the rollers 404, 420, 422 shown and described above. Similarly, the configuration of the first roller 404 shown in FIG. 6C could also be used for the second and third rollers 420, 422. Any combination of the roller 404 shown in FIG. 6C and the roller 404', 420', 422' shown in FIG. 8 could be used for one of the roller wheels 404, 420, 422 described above. One or more of the rollers 404, 420, 422 could be identical, and/or one or more of the rollers 404, 420, 422 could resemble the roller 404', 420', 422' that is lacking in micro projections 410.

FIG. 8 shows a version of a roller 440 that is a wheel having a main body portion 406' and an activating edge 408' configured to compress a groove into the inner surface 19 of the engine cylinder bore 14, as shown in FIGS. 3A-3C. The activating edge 408' is configured to compress a helical groove into the inner surface 19 of the cylinder bore 14, as the roller 440 is rolled along the inner surface 19, as shown in FIGS. 3A-3C above. The activating edge 408' may be disposed on an activating portion 409' that extends from an outer portion 411' of the main body portion 406'. The roller 440 does not have any micro projections 410, 410*a*-410*f*, such as those shown in FIGS. 6C and 7A-7F. Therefore, the roller 440 is configured to create a helical groove having no dimples, such as the helical groove 224 illustrated in FIG. 3C. In addition, the roller 440 may create the helical grooves 34, 36 through the flanks 26, 28 of the first helical groove 24 shown in FIG. 3A.

The main body 406' of the roller 440 may have a height N of about 200 to about 250 μm, or any other desired height to create the helical groove, such as helical grooves 224, 34, 36 in the inner surface 19. Similarly, the activating portion 409' may have a width O in the range of about 200 to about 250 μm.

The roller 440 may be used as any of the rollers 404, 420, 422 described above. In one example, the first roller appears as shown in FIGS. 6A-6C, having micro projections extending from the activating edge 408, while the second and third rollers 420, 422 embody the configuration of the roller 440 illustrated in FIG. 8 and having no micro projections 410.

Figure 9:
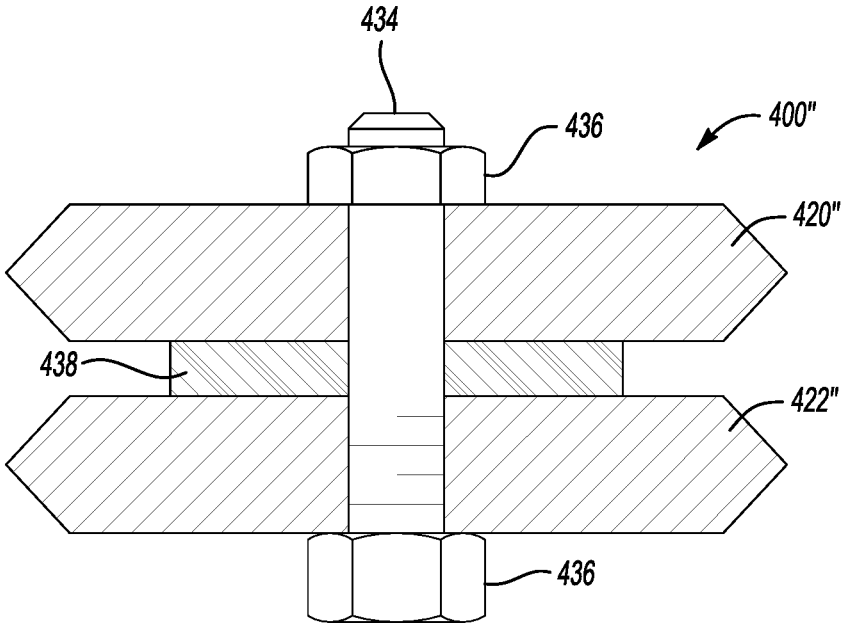
FIG. 9 is a side schematic view of another variation of a portion of the roller assembly shown in FIG. 5, according to the principles of the present disclosure.

Referring now to FIG. 9, an alternate arrangement for a portion of the roller assembly is illustrated and designated at 400", including two of the rollers 420", 422". Instead of one roller 404, 420, 422 per axle 414, 424, 426 of each roller shaft 416, 428, 430, two rollers 420", 422" may be combined onto a single axle 434, which may be coupled to one of the roller shafts 416, 424, 426 via coupling portions 436. A spacer 438 may be disposed between the rollers 420", 422" to keep the rollers 420", 422" spaced apart by a distance s, which could be in the range of about half of the pitch width, or about 100 to about 150 μm. The arrangement of two rollers 420", 422" on a single axle 434 could be substituted for any of the single rollers 404, 420, 422 illustrated in FIG. 5, or the combined axle arrangement shown in FIG. 9 could take the place of two of the roller shafts 416, 428, 430 and associated rollers/axles, if desired. In some variations, three rollers (or any desired number of rollers) could be combined onto a single axle, if desired.

It should be understood the Sdr measurement referred to above is three dimensional. Such surface texture is believed to enhance adhesion of the thermal spray coating by providing connections between the textured surface of the substrate and the thermal spray coating at multiple dimensional sizes or scales from sub-microscopic to microscopic.

The description is merely exemplary in nature and variations are intended to be within the scope of this disclosure. The examples shown herein can be combined in various ways, without falling beyond the spirit and scope of the present disclosure. Such variations are not to be regarded as a departure from the spirit and scope of the present disclosure.

What is claimed is:

1. An engine block comprising:

a plurality of cylinder bores, each cylinder bore having an inner surface, each inner surface having a compressed surface profile that includes a helical groove formed in the inner surface, wherein each cylinder bore surface comprises compressive residual stress having a magnitude of at least 250 MPa; and a thermal spray coating formed on the inner surface of each cylinder bore, the thermal spray coating being adhered to the surface profile of the inner surface.

2. The engine block of claim 1, the surface profile of each inner surface further comprising a plurality of dimples formed in the inner surface.

3. An engine block comprising:

a plurality of cylinder bores, each cylinder bore having an inner surface, each inner surface having a surface profile that includes a first helical groove formed in the inner surface, the first helical groove being defined by a first flank opposite a second flank with an angle defined between walls of the first and second flanks, the surface profile of each inner surface further comprising a second helical groove formed through the first flank of the first helical groove and a third helical groove formed through the second flank of the first helical groove, the surface profile of each inner surface further comprising a plurality of dimples formed in the inner surface, each of the helical grooves having a pitch in the range of about 150 to about 250 μm, the first helical groove having a depth of about 100 to about 250 μm, and each of the dimples having a diameter of about 20 to about 30 μm, the first and the second flanks defining an angle of about 60 to about 75 degrees therebetween; and a thermal spray coating formed on the surface of each cylinder bore, the thermal spray coating being adhered to the surface profile of the inner surface.

4. The engine block of claim 3, wherein each cylinder bore surface comprises compressive residual stress having a magnitude of at least 250 MPa.

5. The engine block of claim 1, wherein each cylinder bore includes a plurality of rough textures each having radii greater than 10 μm and developed interfacial area ratio (Sdr) greater than 100% to enhance coating adhesion.

6. The engine block of claim 4, wherein the each of the inner surfaces of the cylinder bores is formed of aluminum.

7. The engine block of claim 4, wherein each cylinder bore includes a plurality of rough textures each having radii greater than 10 μm and developed interfacial area ratio (Sdr) greater than 100% to enhance coating adhesion.

* * * * *